US008444138B2

(12) United States Patent
Taki

(10) Patent No.: US 8,444,138 B2
(45) **Date of Patent: *May 21, 2013**

(54) SHEET FEEDING APPARATUS AND IMAGE FORMING SYSTEM WITH AIR BLOWER DEVICE

(75) Inventor: Kenji Taki, Toyokawa (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 39 days.

This patent is subject to a terminal disclaimer.

(21) Appl. No.: 12/969,830

(22) Filed: Dec. 16, 2010

(65) Prior Publication Data

US 2011/0163492 A1 Jul. 7, 2011

(30) Foreign Application Priority Data

Jan. 5, 2010 (JP) ..... 2010-000353

(51) Int. Cl.
*B65H 3/08* (2006.01)

(52) U.S. Cl.
USPC ..... 271/108; 271/98; 271/105

(58) Field of Classification Search
USPC ..... 271/97, 98, 108, 11, 105
See application file for complete search history.

(56) References Cited

U.S. PATENT DOCUMENTS

| | | | | |
|---|---|---|---|---|
| 5,344,133 | A | 9/1994 | Jantsch et al. | |
| 6,082,728 | A * | 7/2000 | Ubayashi | 271/108 |
| 6,279,896 | B1 * | 8/2001 | Linder et al. | 271/98 |
| 6,554,269 | B1 | 4/2003 | Dobbertin et al. | |
| 7,419,152 | B2 * | 9/2008 | Adachi | 271/97 |
| 7,591,459 | B2 * | 9/2009 | Matsumoto et al. | 271/97 |
| 7,744,081 | B2 | 6/2010 | Ikeda | |
| 7,823,875 | B2 * | 11/2010 | Fukatsu et al. | 271/153 |
| 7,913,993 | B2 | 3/2011 | Kosugi et al. | |
| 2007/0228639 | A1 * | 10/2007 | Matsumoto et al. | 271/97 |
| 2008/0191406 | A1 * | 8/2008 | Fukatsu et al. | 271/31 |
| 2010/0148425 | A1 * | 6/2010 | Kosugi et al. | 271/11 |
| 2010/0194032 | A1 * | 8/2010 | Shelhart | 271/97 |
| 2011/0012301 | A1 * | 1/2011 | Fukatsu et al. | 271/105 |

FOREIGN PATENT DOCUMENTS

| | | | |
|---|---|---|---|
| JP | 60056739 | A * | 4/1985 |
| JP | 07-089625 | A | 4/1995 |
| JP | 2001-019187 | A | 1/2001 |
| JP | 2004-189432 | A | 7/2004 |
| JP | 2005-75540 | A | 3/2005 |
| JP | 2005-096993 | A | 4/2005 |
| JP | 2005104723 | A * | 4/2005 |
| JP | 2006-264917 | A | 10/2006 |
| JP | 2007-55786 | A | 3/2007 |
| JP | 2008-239312 | A | 10/2008 |
| JP | 2009-208945 | A | 9/2009 |

* cited by examiner

*Primary Examiner* — Jeremy R Severson
(74) *Attorney, Agent, or Firm* — Holtz, Holtz, Goodman & Chick, P.C.

(57) ABSTRACT

A sheet feeding apparatus, having: a sheet stacking table to stack sheets; a sheet feeding device to feed the sheets one by one from an upper most section of the sheets stacked on the sheet stacking table; an assist air blower device to blow an assist air at a lateral side, a front side or a rear side of the sheet fed from the sheet stacking table so as to assist sheet feeding; a detecting device to detect a behavior of the sheet assisted by the assist air; and a control device to set an amount of the assist air used in image forming to be an optimum air amount based on a detected result which is obtained by detecting the behavior of the sheet when the assist air blower device is operated at a predetermined timing while image forming is not carried out.

22 Claims, 7 Drawing Sheets

SHEET FEEDING APPARATUS AND IMAGE FORMING SYSTEM WITH AIR BLOWER DEVICE

This application is based on Japanese Patent Application No. 2010-000353 filed on Jan. 5, 2010, in Japanese Patent Office, the entire content of which is hereby incorporated by reference.

BACKGROUND OF THE INVENTION

The present invention relates to a sheet feeding apparatus to feed sheets one by one to an image forming apparatus and in particular to so-called an air assist method sheet feeding apparatus which assists sheet feeding by blowing air to the sheet when feeding the sheet and an image forming system provided with said sheet feeding apparatus.

TECHNICAL FIELD

An air suction sheet feeding apparatus and a roller sheet feeding apparatus are known as apparatuses to feed the sheets one by one to the image forming apparatuses such as a copying machine and a printing machine.

The air suction apparatus is provided with air suction ducts oppositely disposed above a sheet stacking table on which a plurality of sheets are stacked and a belt member disposed at an outer circumference of the air suction duets in a rotation manner. On the belt member, a plurality of suction holes are formed so that air suctioned by the air suction ducts adheres the sheet through the suction holes so as to feed the sheet to a conveyance roller at a downstream side by rotating the belt member while the sheet is being adhered.

The roller sheet feeding apparatus has rotatable sheet feeding rollers, which separate a sheet on the top from the rest of the sheets and feed. Separation of the sheet is performed by a difference between a friction force between the feeding roller and the sheet, and a friction force between the sheets. When the sheet on the top is fed by the sheet feeding roller, a second sheet and the sheets after the second sheet is dragged by an adhesion force between the sheets and proceeds, which causes double feeding. To prevent double feeding, many a roller sheet feeding apparatus is provided with a retard roller at a downstream side of the sheet feeding roller. The retard roller, provided with a torque limiter, is a roller to be driven in a direction to push the sheet back. When two or more sheets enter, the retard roller serves a separating function to push the second sheet and the sheets after the second sheet back to a tray. In case of one sheet, the retard roller rotates in a sheet feeding direction owing to operation of the torque limiter. Besides the retard roller, there is an apparatus provided with a scraping pad to prevent double feeding.

Incidentally, in recent years, wide varieties of kinds of sheets are used. Different from an ordinary sheet, a coated sheet such as a coated paper, an art paper and an OHP sheet have a large adhesion force in case they are stacked. Thus, they cannot be separated and fed one by one unfailingly, and miss-feeding and double feeding may occur. Also, since the thickness range of the sheets used is being widen, an apparatus, in which a contact pressure of the sheet feeding roller and an air amount of air suction are uniquely determined, is likely to cause miss-feeding and double feeding. Therefore, there is known an apparatus in which the kind and the thickness of the sheet to be stacked in the sheet feeding apparatus are inputted through an operation panel, thereafter parameters related to the sheet are adjusted based on the inputted sheet information.

In order to feed the sheets one by one unfailingly, it is necessary to separate the sheet on the top from the sheets underneath unfailingly. Therefore, various inventions are suggested. For example, in the Patent Document 1: Unexamined Japanese Patent Application Publication No. 2007-55786, there is suggested an air section sheet feeding apparatus provided with a separation air blowing device to blow separation air from a front side of the sheet stacking table. Also, an air section sheet feeding apparatus of the Patent Document 2: Unexamined Japanese Patent Application Publication No. 2008-239312, is provided with a flotation air blowing device to float the sheet on the stacking table by blowing air from a lateral side of the sheet stacking table, in addition to the separation air blowing device.

As to a roller sheet feeding apparatus, Patent Document 3: Unexamined Japanese Patent Application Publication No. 2001-19187 discloses a technology to separate the sheet by blowing air to a sheet bundle from a front side of the sheet feeding direction for preliminary ruffling before sheet feeding. Also, Patent Document 4: Unexamined Japanese Patent Application Publication No. 2005-75540 discloses a technology to ruffle the sheets by blowing air to a sheet bundle form a lateral side with respect to the sheet feeding direction where a setting amount of the air to ruffle is variable in accordance with the kind of the sheet.

The aforesaid method to assist separation feeding of the sheet by air is called an air assist method. In the sheet feeding apparatus of said air assist method, terms such as separation air, flotation air or ruffling air are used. Each air serves not only each function i.e. separation, floating or ruffling but more or less serves other functions, and the terms are used representing main functions. Thus, in the present embodiments the above air is collectively called "assist air".

Generally, an amount of the assist air used to be set in accordance with the kind of the sheet and thickness (basis weight) of the sheet stored in the sheet feeding apparatus by a user. However, the setting amount of air is a typical value which is obtained by measuring popularly used sheet via a maker and the amounts of air conform to all the sheets marketed cannot be set at the apparatus. Therefore, in case the user stores a sheet different form the sheet recommended by the maker or in case the sheet is affected by changes of environments such as temperature and humidity, there are possibilities that miss-feeding and double feeding still occur.

Conventionally, when such miss-feeding or double feeding occurs, the user use to adjust the amount of the assist air to blow through trial and error, however such manual adjustment is extremely time consuming and a considerable number of the sheets are used and wasted.

To cope with the above problems, Patent Document 5: Unexamined Japanese Patent Application Publication No. 2006-264917 discloses a roller sheet feeding apparatus, having a configuration to blow air from a rear of stacked sheets, to control feeding the sheet when a ruffling condition of the sheets reaches at an appropriate level by detecting the ruffling condition at each printing, Also, as for the air suction sheet feeding apparatus and the roller sheet feeding apparatus, Patent Document 6: Unexamined Japanese Patent Application Publication No. 2009-208945 discloses a technology, having a configuration to supply the separation air to the sheet from the lateral side wherein the amount of the separation air is controlled by detecting a change of humidity. Specifically, the amount of air is controlled to be changed in accordance with change of humidity for a sheet type (coated sheet) whose adhesion force increases in a high humidity environment, and the amount of air is controlled to be stable for the other types of the sheets.

Patent Document 1: Unexamined Japanese Patent Application Publication No. 2007-55786, Patent Document 2: Unexamined Japanese Patent Application Publication No. 2008-239312

Patent Document 3: Unexamined Japanese Patent Application Publication No. 2001-19187

Patent Document 4: Unexamined Japanese Patent Application Publication No. 2005-75540

Patent Document 5: Unexamined Japanese Patent Application Publication No. 2006-264917

Patent Document 6: Unexamined Japanese Patent Application Publication No. 2009-208945

However, even by the technologies of the above Patent documents, the amount of the assist air cannot be controlled optimally with respect to all types of sheets, and problems of miss-feeding and double feeding still exist. Also, in the technology of Patent Document 5, since sheet feeding is executed after a condition of ruffling for each printing reaches to a predetermined level, there is a problem that it requires time until sheet feeding starts.

SUMMARY

The sheet feeding apparatus of the present invention controls an assist air blowing device and detects a behavior of a sheet assisted by the assist air at a predetermined timing while an image is not formed, then an appropriate air amount is determined based on a detected value as an amount of assist air used for ordinary sheet feeding.

Specifically, a sheet feeding apparatus, comprising: a sheet stacking table to stack sheets; a sheet feeding device to feed the sheets one by one from an uppermost section of the sheets stacked on the sheet stacking table; an assist air blower device to blow an assist air at a lateral side, a front side or a rear side of the sheet fed from the sheet stacking table so as to assist sheet feeding; a detecting device to detect a behavior of the sheet assisted by the assist air; and a control device to set an amount of the assist air used in image forming to be an optimum air amount based on a detected result which is obtained by detecting the behavior of the sheet when the assist air blower device is operated at a predetermined timing while image forming is not carried out.

Further specifically, a sheet feeding apparatus, comprising: a sheet stacking table to stack sheets; an air suction sheet feeding device to feed the sheets one by one from an upper most section of the sheets stacked on the sheet stacking table, having an air suction member, disposed to oppose an upper surface of the sheet stacked, to suction the sheet and a perforated belt member disposed in a rotation manner so as to turn about an outer circumference of the air suction member; a flotation air blower device to blow a flotation air at a lateral side, a front side or a rear side of the sheet fed from the sheet stacking table so as to float the sheet; a separation air blower device to blow a separation air at a lateral side, a front side or a rear side of the sheet fed from the sheet stacking table so as to separate the sheet suctioned by air; a detecting device to detect a behavior of the sheet separated by the separation air; and a control device to set an amount of the separation air used in image forming to be an optimum air amount based on a detected result which is obtained via the detecting device by detecting that the sheet, floated at a predetermined position by operating the flotation air blower device and the separation air blower device, leaves from a predetermined position at a predetermined timing while image forming is not carried out.

Or, a sheet feeding apparatus, comprising: a sheet stacking table to stack sheets; an air suction sheet feeding device to feed the sheets one by one from an upper section of the sheets stacked on the sheet stacking table, having an air suction member disposed to oppose an upper surface of the sheet stacked to suction the sheet and a perforated belt member disposed in a rotation manner so as to turn about an outer circumference of the air suction member; a flotation air blower device to blow a flotation air at a lateral side, a front side or a rear side of the sheet fed from the sheet stacking table so as to float sheet; a detecting device to detect a behavior of the sheet floated by the flotation air; and a control device to set an amount of the flotation air used in image forming to be an optimum air amount based on a detected result which is obtained via the detecting device by detecting a behavior of the sheet floated by operating the flotation air blower device and the air suction sheet feeding device at a predetermined timing while image forming is not carried out The above sheet feeding apparatuses is integrally stored inside the image forming apparatus, or combined with the image forming apparatus as a separate unit to configure an image forming system.

DETAILED DESCRIPTION OF PREFERRED EMBODIMENTS

Figure 1:
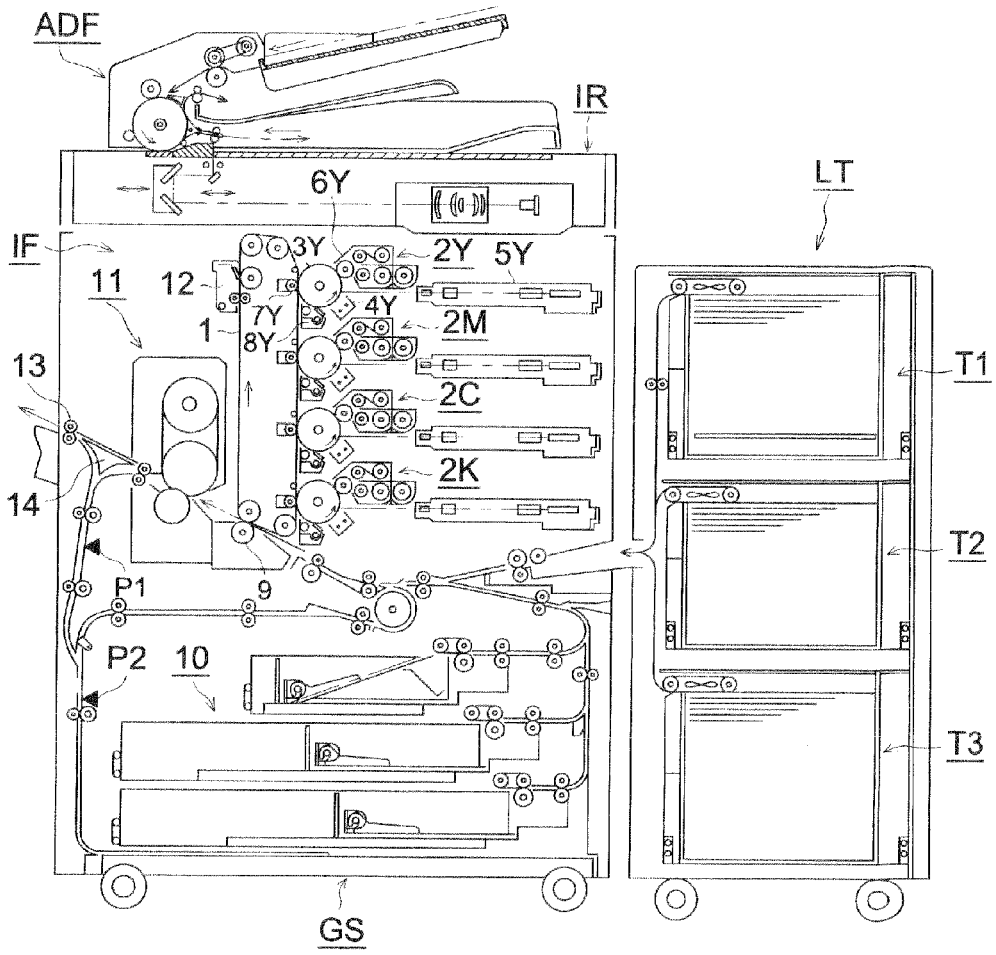
FIG. 1 is an overall configuration diagram of an image forming system related to the present invention.

As a first embodiment of the present invention, an image forming apparatus utilizing the present invention will be described with reference to the drawings. FIG. 1 is an overall configuration diagram of an image forming system having an image forming apparatus main body GS and a large capacity sheet feeding apparatus LT. The present invention is applied to the large capacity sheet feeding apparatus LT. The large capacity sheet feeding apparatus, as a separate unit, can configure a system along with the image forming apparatus. Also, there can be an integrated configuration where the large capacity sheet feeding apparatus is combined with the image forming apparatus.

In FIG. 1, the large capacity sheet feeding apparatus LT is provided with three sheet feeding stages i.e. T1, T2 and T3 connected with a sheet feeding path of the image forming apparatus GS. Each sheet feeding stage is configured to be withdrawn forward via a sliding rail so as to carry out maintenance.

The image forming apparatus main body GS is provided with an automatic document conveyance apparatus ADF and an image reading section IR at an upper part thereof and a lower section thereof is configured with an image forming section IF.

The image forming section 1F is provided with a vertically long intermediate transfer belt 1 to convolve at a center thereof and on a right side of the intermediate transfer belt, a yellow image forming unit 2Y, a magenta image forming unit 2M, a cyan image forming unit 2C and a black image forming unit 2K are disposed in the above order from the top.

Since configurations of respective units are the same, only the yellow image forming unit will be described. A photoconductive drum 3Y on a left side of the yellow image forming unit 2Y is disposed so as to contact with the intermediate transfer belt 1, and at a circumference of the photoconductive drum 3Y, a charging device 4Y, a laser writing device 5Y, a developing device 6Y, a primary transfer roller 7Y (the reverse side of the intermediate transfer belt 1) and a cleaning device 8Y are disposed in order in an anticlockwise direction. In the description hereinafter, symbols without Y, M, C and K (namely numerals) denotes the part common for each color.

Under the automatic document conveyance apparatus ADF the image reading section IR is disposed. The image reading section IR reads an image of a document fed to a reading position via the automatic document conveyance apparatus ADF or an image of a document placed on a document glass, and supplies it to the laser writing device 5. Incidentally, if the apparatus has a printing function, image data sent from a personal computer and so forth can be supplied to the laser writing device 5 to be printed.

The photoconductive drum 3 is charged evenly via the charging device 4, thereafter an image is written on the photoconductive drum 3, whereby an electrostatic latent image is formed on the photoconductive drum. The electrostatic latent image is developed to be a toner image via the developing device 6, and transferred onto the intermediate transfer belt 1 via a primary transfer roller 7.

When the toner images of respective colors are overlapped on the intermediate transfer belt 1, the toner image is transferred onto a sheet supplied from one of the sheet feeding stages in the sheet storing section 10 or in the large capacity sheet feeding apparatus LT via the secondary transfer roller 9. The toner image transferred onto the sheet is fixed by the fixing device 11. Also, the intermediate transfer belt 1 is cleaned by the belt cleaning device 12.

The sheet on which the toner image is fixed by the fixing device 11 proceeds as it is, and is ejected through ejection rollers 13 or conveyed downward through a conveyance path changeover member 14. When a rear end of the sheet reaches at a reversal sheet feeding point P1, the sheet is conveyed backward in the conveyance path and ejected while having the formed image on an under surface through the conveyance path changeover member 14 and the ejection rollers 13.

On the other hand, in case of a both sides mode, the sheet is conveyed to downward through the conveyance path changeover member 14. When the rear end of the sheet reaches at a both sides reversal point P2, the sheet is conveyed backward in the conveyance path and proceeds to a both sides conveyance path then the sheet is returned to the transfer position again so as to form an image on the reverse side of the sheet.

Figures 2A, 2B:
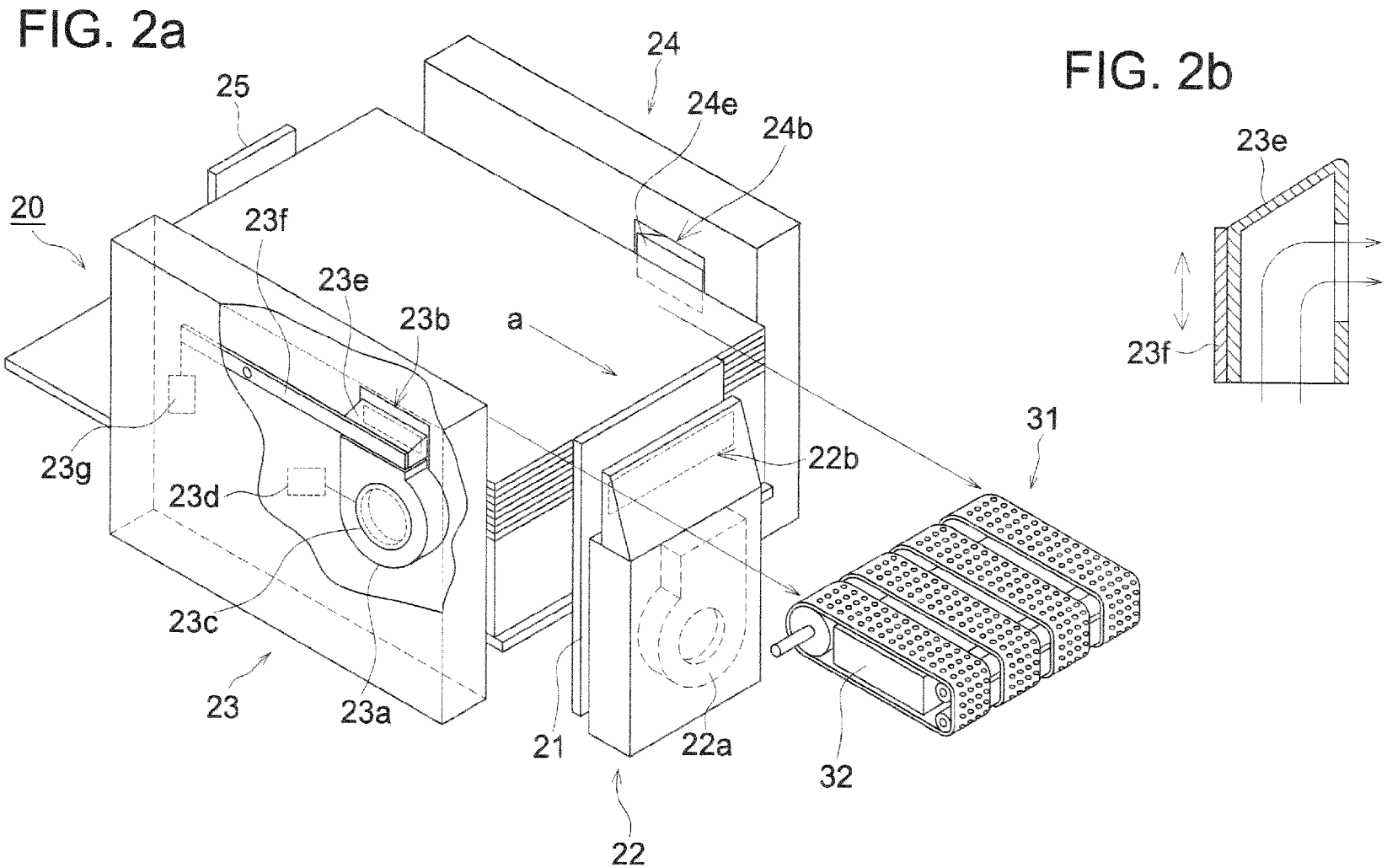
FIG. 2*a* is a perspective view showing an outline of an air suction sheet feeding apparatus related to the present invention.
FIG. 2*b* is a cross-sectional view of a blower nozzle.

FIG. 2 (*a*) is a perspective view showing an outline of an air suction sheet feeding apparatus (sheet feeding stages T1, T2 and T3) of the large capacity sheet feeding apparatus LT to which the resent invention is applied, and FIG. 2 (*b*) is a cross-sectional view of a blower nozzle to be described. In FIG. 2 (*a*), the sheets stacked on the sheet stacking table 20 is conveyed one by one in a direction of an arrow. The sheet stacking table 20 is provided with a lifting mechanism (unillustrated) which ascends the sheet stacking table 20 so that a sheet on an uppermost position always keeps a predetermined position and descends when the sheet is replenished.

In front of the sheet stacking table 20, a front edge registration member 21 is disposed, and at a downstream side of the front edge registration member 21, a separation air blower section 22 is disposed. Also, at both sides of the sheet stacking table 20, flotation air blower sections 23 and 24 are provided. In side surface of side surfaces of the flotation air blower sections 23 and 24 perform side registration of the sheet. At the back of the sheet stacking table 20, a rear end registration member 25 is disposed.

In side the separation air blower section 22, and the flotation air blower sections 23 and 24, blower fans 22*a*, 23*a*, and 24*a* are disposed respectively so that air outlets 22*b*, 23*b* and 24*b* blow air.

The respective blower fans 22*a*, 23*a* and 24*a* are provided with shutters at air suctioning opening sections so as to turn off and on the air by opening and closing of the shutters. In FIG. 2 (*a*), a shutter 23*c* of the blower fan 23*a* and an opening and closing solenoid 23*d* are only shown. Incidentally, as described later, the blower fans 22*a*, 23*a* and 24*a* are configured so that air amounts are changed by controlling supplied power.

Also, the flotation air blower sections 23 and 24 are provided with movable air blow nozzles 23*e* and 24*e* so as to move air flow from the air blow outlets 23*b* and 24*b* up and down. In FIG. 2 (*a*), the air blow nozzle is shown only at the flotation air blow section 23, and FIG. 2 (*b*) shows a cross section of the air blower nozzle 23*e*.

The blower nozzle 23*e* is retained by an unillustrated guide so as to movable up and down with respect to the air outlet 23*b*, and the back side of the air blower nozzle (an opposite side with respect to the air outlet 23*b*) is supported by an end section of a plate-like member 23*f*. The plate-like member 23*f* is supported pivotally at a vicinity of a center thereof and connected with a solenoid at another end section.

The air blower nozzles 23*e* and 24*e* are controlled to ascend to accord with a floating sheet floated by the flotation air at a time of sheet feeding and to descend after sheet feeding. In the present embodiment, the air blow nozzles 23*e* and 24*e* locate at a bottom position to blow the flotation air when the amount of the flotation air is adjusted and locate at a top position to blow the flotation air when the amount of the separation air is adjusted.

Above the sheet stacked in the sheet stacking table 20, an air suction sheet feeding section 30 is disposed. In the FIG. 2 (*a*), the conveyance belt 31 representing a part the sheet stacking table is shown at a shifted position shown by arrows. The conveyance belt 31 has an air suction duct 32 inside.

The sheet on the sheet stacking table 20 is suctioned by the air suction sheet feeding section 30. When this occurs, air from the floatation air blower sections 23 and 24 blows both side surfaces of the sheet so as to float several number of the sheets, and air from the separation air blower section 22 separates one sheet suctioned by the air suction sheet feeding section 30 from the rest of the sheets so that one sheet is suctioned by air unfailingly.

Figure 3:
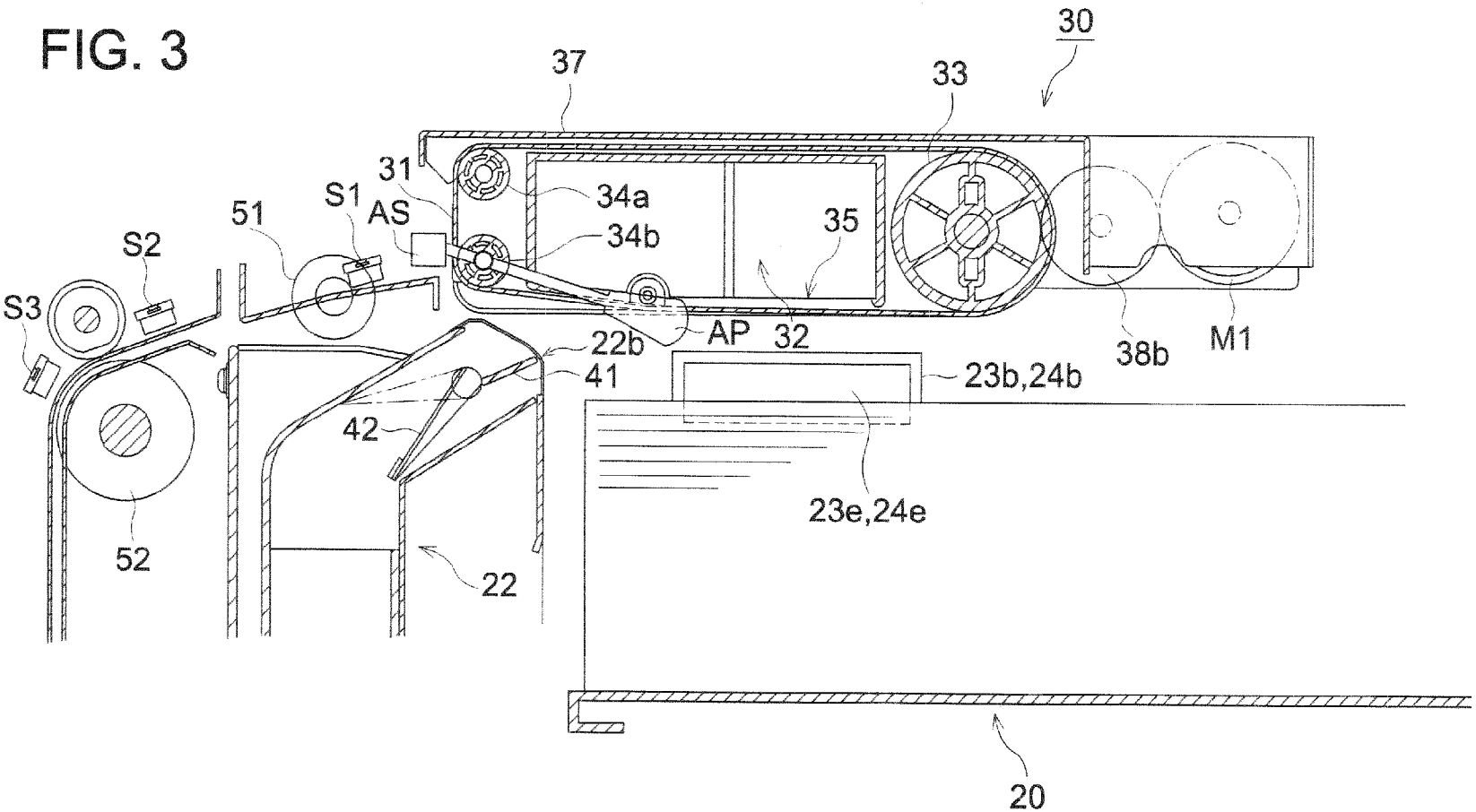
FIG. 3 is a cross-sectional view of a relevant portion of an air suction sheet feeding apparatus related to the present invention.
Figure 4:
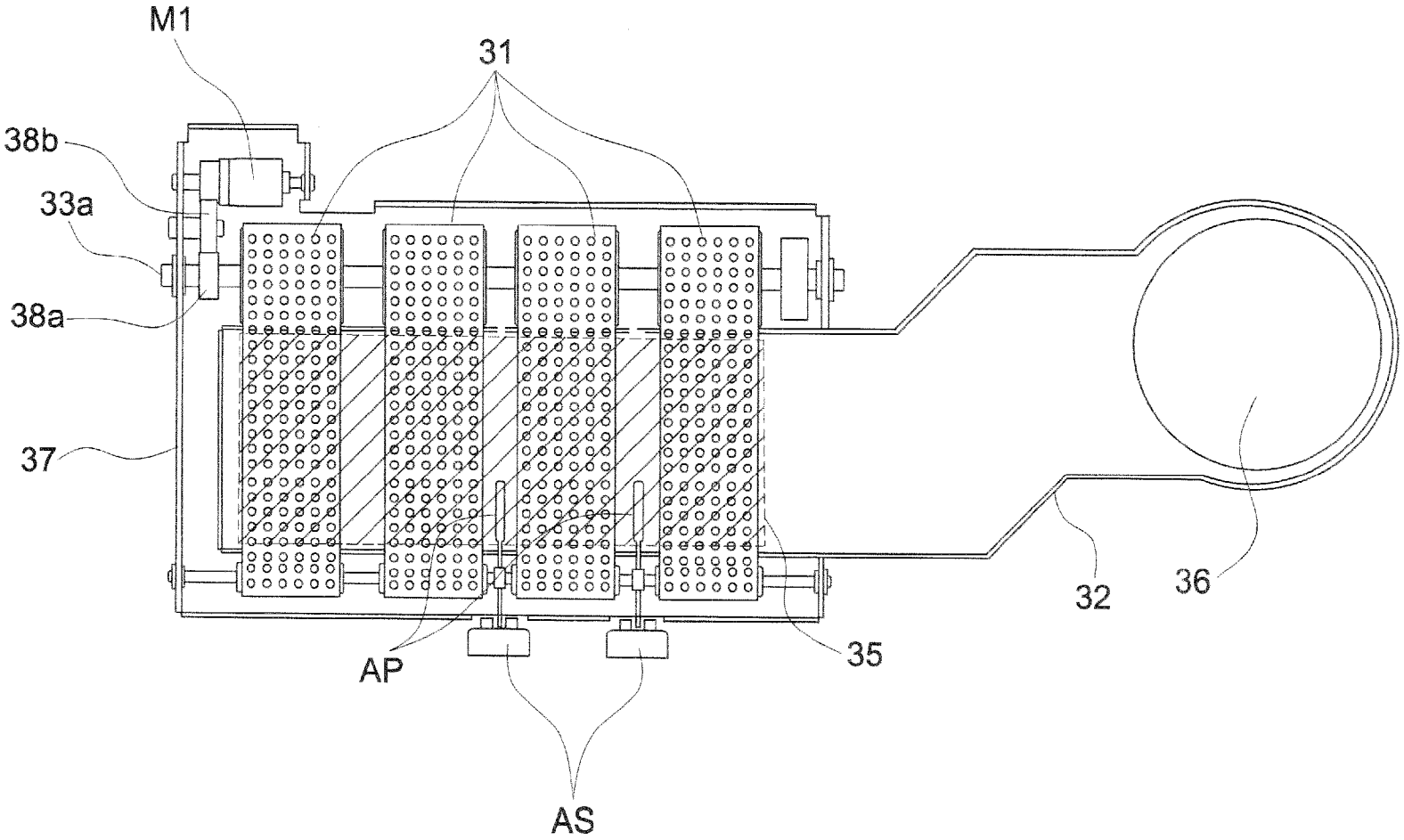
FIG. 4 is a bottom view of an air suction sheet feeding apparatus related to the present invention.

FIG. 3 is a cross-sectional view of a relevant portion of an air suction sheet feeding section 30 and a configuration of periphery thereof, and FIG. 4 is a bottom view of the air suction sheet feeding section viewed from underneath in FIG. 3. The air suction sheet feeding section 30 will be described with reference to FIG. 3 and FIG. 4.

The air suction sheet feeding section 30 located above the sheet stacking table 20 is provided with an air suction ducts 32, a large diameter roller 33 disposed at a rear of the air suction duct 32 in the sheet conveyance direction, two small diameter rollers 34*a* and 34*b* disposed in front of the air suction duct 32 in the sheet feeding direction, and the conveyance belt 31 to rotate around the rollers thereof. The conveyance belt 31 is a perforated belt on which a number of holes are formed. As FIG. 4 shows four conveyance belts are disposed laterally with respect to the conveyance direction.

The large diameter roller 33 and the small diameter rollers 34*a* and 34*b* are formed in barrel shapes so as to prevent the belt from running off.

The air suction duct 32 has a portion to correspond with the four conveyance belts 31 and a portion extending to a back side of the apparatus, and has a suction opening 35 at a lower surface side of the portion corresponding to the conveyance belts 31. At an innermost of the extending portion of the air suction duct 32 extending to the back side of the apparatus, a suction fan 36 is disposed.

The air suction duct 32 is provided with a retaining plate 37 at an upper side thereof, the large diameter roller 33, the small diameter rollers 34*a* and 34*b* are pivotally supported by a front side retaining section extending downward from a retaining plate 37 and a back side retaining section, and a gear 38*a* is provided at a front side of an axis 33*a* of the large roller 33. The gear 38*a* is connected with a motor M1 having a clutch via an intermediate gear 38*b*. The both intermediate gear 38*b* and the motor M1 having the clutch are retained by the retaining plate 37.

Also, at two positions between the small diameter rollers 34*a* and 34*b*, a suction sensor AS and a detection flap AP thereof are disposed. When the sheet is suctioned by air, the detection flap AP is moved into a space between the conveyance belts 31 so as to turn on the suction sensor AS. Thus the suction of the sheet can be detected.

In FIG. 3, beneath the small diameter roller 34*b* of the air suction sheet feeding section 34, the separation air blower section 22 are disposed. In side the air outlet 22*b* of the separation air blower section 22, a bulkhead 41 and a change over plate 42 are disposed. The changeover plate 42 switches between a solid line position and a dashed-dotted line position so as to change air blow positions of the separation air. When suctioning of the sheet starts, the changeover plate 42 is at the dashed-dotted line position so as to blow air from a lower side of the air outlet, then when several number of the sheets float via the flotation air and suctioned by air, the changeover plate 42 displaces to the solid line position so as to blow air from an upper side of the air outlet, whereby the sheet is unfailingly separated.

Also, as described in the foregoing, while the flotation air blower sections 23 and 24 are disposed at both ends of the sheet on the sheet stacking table 20, in FIG. 3 only the air outlets 23*b* and 24*b* and the air blower nozzles 23*e* and 24*e* are shown.

An auxiliary conveyance roller 51 is disposed above the separation air blower section 22 and a conveyance roller 52 is disposed at a downstream side of the auxiliary roller 52 in the conveyance direction. Sheet sensors S1, S2 and S3 are disposed at an upstream side of the auxiliary roller 51 and in front and back of the conveyance roller 52 for detecting the sheet so as to control conveyance of the sheet thereof and the air suction sheet feeding section 30.

In an ordinary operation (in sheet feeding), when a sheet feeding command is received, the air suction sheet feeding apparatus of the present embodiment turns on the flotation air blower sections 23 and 24, then turns on the suction fan 36 of the air suction sheet feeding section 30 to float the sheet and to suction the sheet floating via the conveyance belt. Since several number of the sheets float, the separation air blower section 22 is turned on so that only the sheet on the top is suctioned via the conveyance belt 31 and the rest of the sheets are separated from the sheet on the top and returned onto the sheet stacking table 20.

Here, the air amounts of the flotation air blower section and the separation air blower section are determined to the optimum amounts for the sheet used. In the present embodiment, said optimum air amounts can be set automatically.

Figure 5:
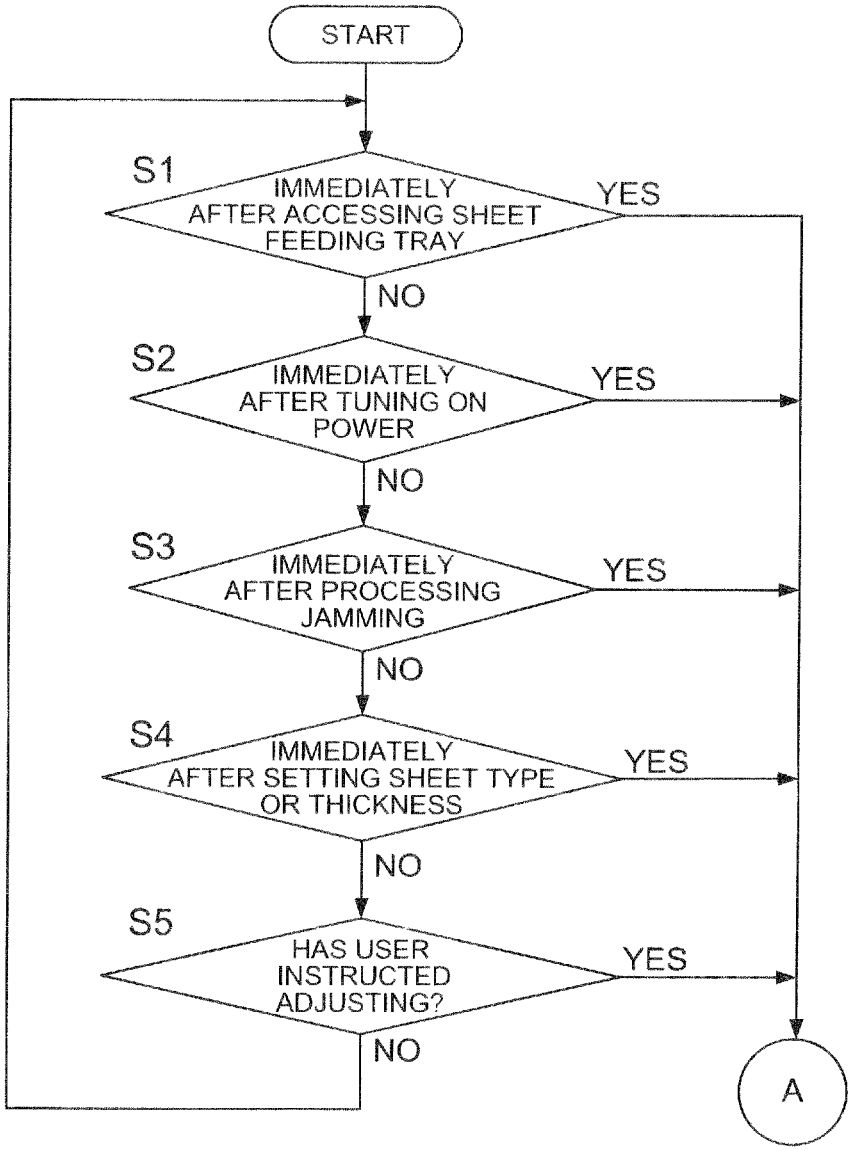
FIG. 5 is a flow chart indicating a program of an air amount setting of an air suction sheet feeding apparatus related to the present invention.
Figure 6:
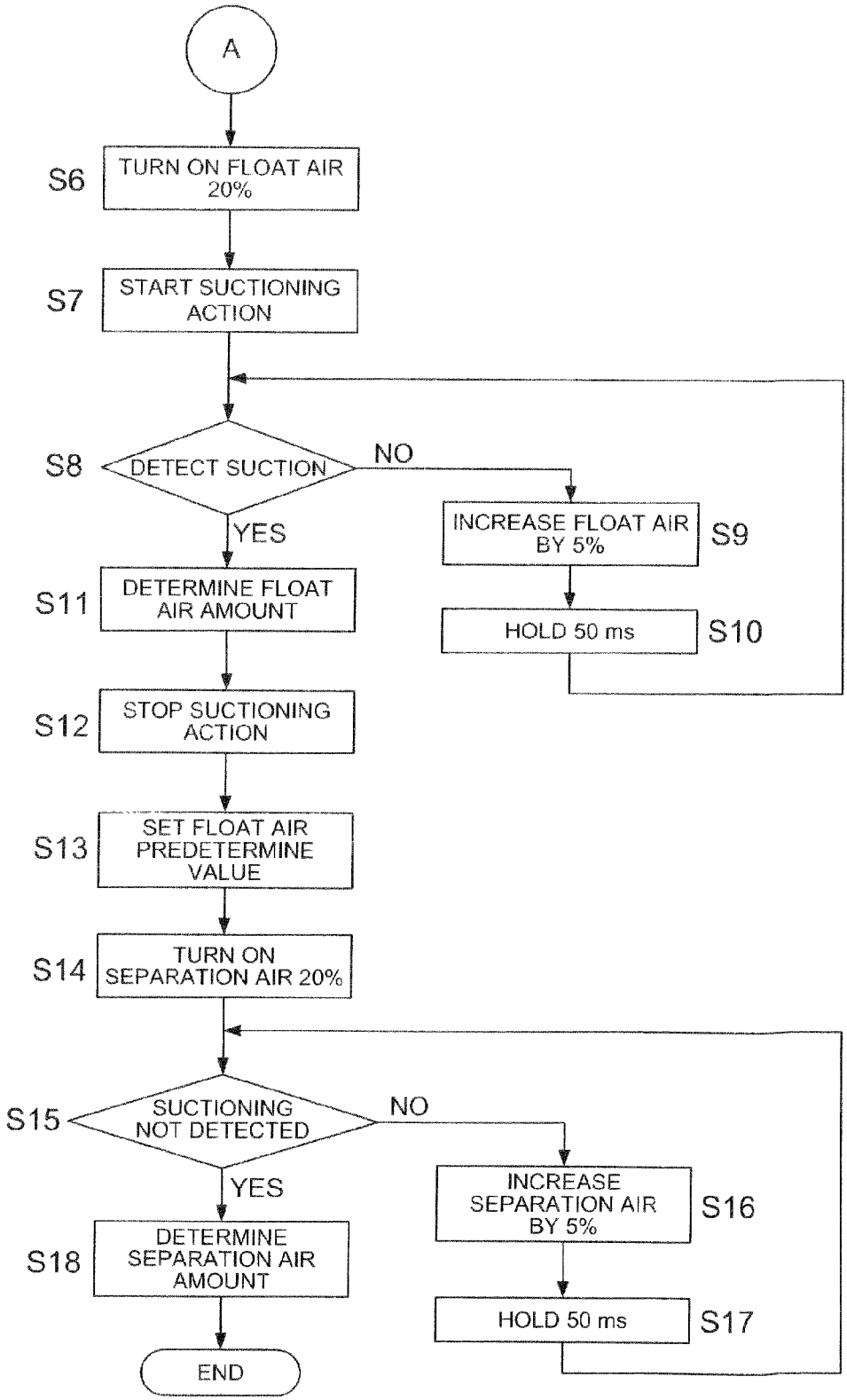
FIG. 6 is a flow chart indicating a program of an air amount setting of an air suction sheet feeding apparatus related to the present invention.

The flow charts in FIG. 5 and FIG. 6 are for sub-routine programs in a program of the control device of the large capacity sheet feeding apparatus LT to set the air amount.

In the present embodiment, the air amount is automatically adjusted immediately after the user accesses any one of sheet feeding stages T1, T2 or T3 of the image forming apparatus main body (Step S1), immediately after tuning of the power (Step S2), immediately after jamming is processed (Step S3), immediately after inputting kind or thickness of the sheet loaded on each of the sheet stages T1, T2 and T3 through the operation panel (Step S4), or after an air amount adjusting instruction of the user is inputted through the operation panel (Step S5).

More specifically, immediately after an access of the user in Step S1 means after the user opens and closes any one of the sheet feeding stages T1, T2 and T3, which is deemed that the sheet is replenished, thus the air amount is set. Immediately after turning on the power in Step 2 means immediately after turning on all power sources in the literature and further, it may mean after a predetermined time is elapsed from turning off the power or turning on the power under a condition that the fixing device is below a predetermined temperature. Because, in a state where the power is turned on again within a short time after the power is turned off, it is considered that replenishing of the sheet is not carried out while the power is turned off. Thus the setting of the air amount after turning on the power in such sort interval is omitted.

Also, "immediately after the jamming is processed" in Step S3, means after Fixing jamming due to miss-feeding or double feeding. "Immediately after kind or thickness of the sheet is inputted form the operation panel" in Step S4 includes a case that kind and thickness of the sheet is inputted via a method other than that the user input through the operation panel, for example, in case information of the sheet is transmitted via a network and set in the control device, Further "after an air amount adjusting instruction of the user" in Step S5 includes a case that the user instructs adjustment of air amount so as to an optimum air amount is further set when a trouble, not so serious as jamming, such as a minor displacement occurs between the sheet and the image in sheet feeding.

If one of Steps S1 to S5 in FIG. 5 is "Yes", automatic setting is carried out in Step S6.

First, the air amount of the flotation air is adjusted in Steps S6 to S12. In Step S6, the air amount of the flotation air is set at 20% of the maximum value of the air amount of the fan. Then in Step S7, suctioning starts by tuning on the suction fan 36 of the air suction sheet feeding section 30 in Step 7. Incidentally, the air amount of the suction fan 36 is determined at a constant value.

Then in Step S8, whether or not the suctioning of the sheet is detected is judged by turning on the suction sensor AS. If the sheet is not suctioned, the air amount of the flotation air is increased by 5% in Step S9 and after a waiting time of 50 ms for stabilizing the air amount is elapsed, returning to Step 8, suctioning of the sheet is judged.

If the sheet is judged to be suctioned in Step S8, an air amount of the flotation air used for sheet feeding is determined, by adding a predetermined margin to the air amount at the judgment. The determined air amount of the flotation air is stored in a memory of the control device to be used for sheet feeding.

Next, in Step S12, suctioning operation halts, namely the suction fan 36 is turned off and the amount of the separation air is adjusted in Steps S13 to S18. In Step S13, the air amount of the flotation air is set at a predetermined value and the flotation air is turned on. The above predetermined value is an air amount which is obtained by further increasing the air amount determined in Step S11 by 5%. Since the above flotation air amount is greater than the air amount of ordinary sheet feeding, the sheet is adhered onto the conveyance belt 31 even the suction fan 36 is turned off.

After Step S13, in Step S14, the air amount of the separation air is set at 20% of the maximum value and the separation air is turned on. Then in Step S15, whether or not the sheet is separated, namely in a non-adhering state and the suction sensor AS is turned off is judged. If the suction sensor AS remains ON, in Step S16, the air amount of the separation air is increased by 5% and after the waiting time of 50 ms for stabilizing the air amount is elapsed, returning to Step 15, whether or not the sheet is not suctioned is judged.

Here, in Step S12, since the suction fan 36 is turned off, the sheet floats only by the flotation air, and since the air amount of the flotation air is increased by 5% with respect to a normal condition, the sheet is in an adhered state where the sheet is pressed onto the conveyance belt 31. From the above state, in Step S14 by increasing the air amount of the separation air subsequently, the sheet is separated from the conveyance belt 31 at a point of the air amount. The separation of the sheet is confirmed by that the suction sensor AS is turned off, then an air amount of the flotation air used for sheet feeding is determined by adding a predetermined margin to the air amount when the sheet is separated. The determined air amount of the flotation air is stored in the memory of the control device to be used for sheet feeding.

Incidentally, through the description is omitted in the flow charts, the changeover plate 42 of the separation air blower section 22 is set at the position of the solid line, and the air blower nozzles 23*e* and 24*e* of the floatation air blower sections 23 and 24 are set at the lower position at the time of flotation air adjusting and the upper position at the time of separation air adjusting.

The air amounts determined in Step S11 and Step S18 are calculated through the formulas below.

Flotation air amount air amount when suction sensor is on×1.2×A.

Separation air amount=air amount when suction sensor is off×1.2×B

Compensation coefficients A and B are determined as follow. While the compensation coefficients are 1.00 in normal conditions, in case that immediately after jamming is processed in Step S3, the values differ from that in the normal conditions.

Normal condition: A=1.00, B=1.00

Double feeding jamming: A=1.00, B=1.05

Non-suction jamming: A=1.05, B=1.00

Sheet feeding jamming: A=0.95, B=1.00

Namely, when jamming occurs, the compensation coefficients are changed in accordance with the type of the jamming. In the air amounts determined in Steps S11 and S18, the margins are added to the measured air amounts, thus the determined amounts may deviated from the optimum amount depending on the sheets, and in such case the jamming occurs.

In case that double feeding jamming occurs, since the amount of the separation air is insufficient, the air amount is increased by 5%, and in case of non-suction jamming, since the air amount of the flotation air is insufficient, the air amount is increased by 5%. Sheet feeding jamming occurs in case the sheet does not reach at the sheet sensor S1 in a predetermined timing which is caused by flopping of the sheet due to an excessive air amount of the flotation air, therefore, the air amount of the flotation air is reduced by 5%.

Incidentally, in case the judgment results in Steps S11 and S18 are not "Yes", though the air amount is increased gradually, a mechanical malfunction is predicted. Thus an alert is displayed on the operation panel to give notice to the user.

In the above embodiment, while the detection device is to detect a time where the sheet arrives at the suction sensor, sheet detection is possible in other methods. For example, the suction sensor is used as it is, and while the amounts of the flotation air and the separation air are unchanged, by measuring a time span where the sheet arrives at the suction sensor (in case of flotation air adjustment) and a time span where the sheet leaves from the suction sensor (in case of separation air adjustment), the air amounts are determined.

Or the air amount can be set based on the detected height of the sheet wherein by disposing a line sensor vertically above the stacked sheet bundle, a height of the sheet floats up in a predetermined time is detected while keeping the air amount of the flotation air constant.

In any cases, the optimum air amounts can be set by determining the margin and the compensation coefficient of the air amount for the calculation formula through the experience in advance.

Figure 7:
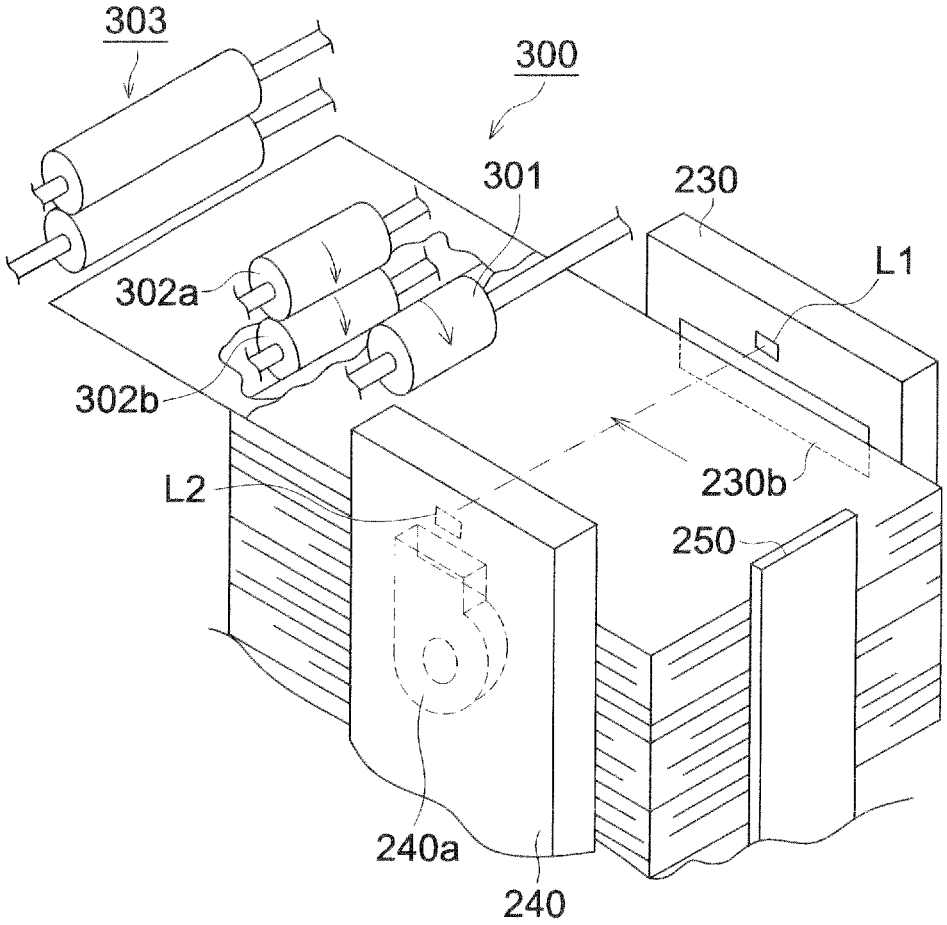
FIG. 7 is a perspective view of a roller sheet feeding apparatus of the present invention.

Also, the present embodiment can be adapted to the roller sheet feeding apparatus besides the above air suction sheet feeding apparatus. FIG. 7 is a perspective view to describe an embodiment to which the present invention is applied. In FIG. 7 a numeral 300 denotes a roller sheet feeding mechanism having a sheet feeding roller 301 to be placed on the sheet, a separation roller 302*a* and a pair of ruffling rollers 302*b* at a downstream side of the sheet feeding roller 301, and a conveyance roller 303 at a downstream thereof Since the roller sheet feeding mechanism is a publicly known mechanism, a specific description is omitted.

Ruffling air blower sections 230 and 240 are disposed at lateral sides of the sheet stacked on the sheet stacking table. The ruffling air blower sections 230 and 240 are configured the same as the aforesaid flotation air blower sections 23 and 24, having fans 230*a* and 240*a* inside so as to blow the ruffling air from air outlets 230*b* and 240*b* (230*a* and 240*b* are not illustrated).

The ruffling air blower sections 230 and 240 serve a function to ruffle the sheets by bowing air among a plurality of the sheets from both sides of the sheet bundle when feeding the sheet. Since the feeding roller 301 is placed on the sheet on the top, only a rear portion of the sheet in the conveyance direction is ruffled by the ruffling air. By the ruffling air, adhering forces among the sheets can be reduced, thus single sheet feeding via sheet feeding roller 301 can be sufficiently assisted.

The timing and control method to automatically adjust the air amount of the ruffling air is the same as that to automatically adjust the flotation air in the first embodiment. However, since the present sheet feeding device has no suction sensor, a light emitting element L1 and a light receiving element L2 are disposed at positions opposing the ruffling air blower sections 230 and 240. The optimum air amount is set using an air amount when the light emitted from the light emitting element L1 is interrupted by the sheet floated by the ruffling air and the light does not reach at the light receiving element L2. The height at which the light emitting element L1 and the light receiving element L2 are disposed is the standard height.

As another method, a mechanical sensor such as the suction sensor can be disposed at the standard height.

As above, in the present invention, since the air amount is automatically set by actually blowing the assist air (flotation air, separation air and ruffling air), the optimum air amount of the assist air can be set irrespective of the kind and thickness of the sheet stacked. Also, for example, in case the user replenishes different kind and thickness of the sheets from the sheets set in the sheet feeding stages since the optimum air amount is measured and set at replenishment, there is not possibility of occurrence of jamming.

What is claimed is:

1. A sheet feeding apparatus, comprising:

a sheet stacking table to stack sheets;

a sheet feeding device to feed the sheets one by one from an uppermost section of the sheets stacked on the sheet stacking table;

an assist air blower device to blow an assist air at a lateral side, a front side or a rear side of the sheet fed from the sheet stacking table so as to assist sheet feeding;

a detecting device to detect a behavior of the sheet assisted by the assist air; and a control device to set an amount of the assist air used in image forming to be an optimum air amount based on a detected result which is obtained by detecting the behavior of the sheet when the assist air blower device is operated at a predetermined timing while image forming is not carried out;

wherein the control device calculates the optimum air amount by adding a predetermined margin to an air amount based on detected information.

2. A sheet feeding apparatus, comprising:

a sheet stacking table to stack sheets;

an air suction sheet feeding device to feed the sheets one by one from an upper most section of the sheets stacked on the sheet stacking table, the air suction sheet feeding device comprising (i) an air suction member, disposed to oppose an upper surface of the sheet stacked, to suction the sheet, and (ii) a perforated belt member disposed in a rotational manner so as to turn about an outer circumference of the air suction member;

a flotation air blower device to blow a flotation air at a lateral side, a front side or a rear side of the sheet fed from the sheet stacking table so as to float the sheet;

a separation air blower device to blow a separation air at a lateral side, a front side or a rear side of the sheet fed from the sheet stacking table so as to separate the sheet suctioned by air;

a detecting device to detect a behavior of the sheet separated by the separation air; and a control device to set an amount of the separation air used in image forming to be an optimum air amount based on a detected result which is obtained via the detecting device by detecting that the sheet, floated at a predetermined position by operating the flotation air blower device and the separation air blower device, leaves from a predetermined position at a predetermined timing without the air suction sheet feeding device being operated while image forming is not carried out.

3. The sheet feeding apparatus of claim 1, wherein the detection device is to detect the sheet at a standard height which is higher than a height of the sheets stacked by a predetermined amount, and the control section sets the optimum air amounts using an air amount when the sheet reaches the standard height by gradually increasing an air amount of the assist air blower device, the separation air blower device or the flotation air blower device, or an air amount at which the detection device detects that the sheet leaves from the standard height.

4. The sheet feeding apparatus of claim 1, wherein the detection device is configured to detect the sheet at a standard height which is higher than a height of the sheets stacked by a predetermined amount, and the control section sets the optimum air amounts based on a measured time at which the sheet reaches the standard height or at which the sheet leaves the standard height while keeping the air amount of the assist air blower device, the separation air blower device or the flotation air blower device constant.

5. The sheet feeding apparatus of claim 1, wherein the detection device is configured to detect a height at which the sheet floats, and the control device is configured to set the optimum air amount based on a measured height to which the sheet reaches within a predetermined time while keeping the air amount of the assist air blower device constant.

6. The sheet feeding apparatus of claim 1, wherein the sheet feeding device comprises one of (i) a roller sheet feeding device having a sheet feeding roller to feed the sheet by a friction force between the sheet feeding roller and the sheet on another sheet stacked, and (ii) an air suction sheet feeding device, the air suction sheet feeding device comprising (a) an air suction member to suction the sheet disposed to oppose an upper surface of the sheet stacked and (b) a perforated belt member disposed in a rotational manner so as to turn about an outer circumference of the air suction member.

7. The sheet feeding apparatus of claim 2, wherein the control device calculates the optimum air amount by adding a predetermined margin to an air amount based on detected information.

8. The sheet feeding apparatus of claim 7, wherein the control device compensates the calculated optimum air amount in accordance with a kind of jamming after occurrence of the jamming.

9. An image forming system, comprising:

the sheet feeding apparatus of claim 1; and an image forming apparatus to form an image on the sheet fed from the sheet feeding device.

10. The sheet feeding apparatus of claim 1, wherein the predetermined timing is any one of a timing after operating the sheet feeding table to set the sheet, a timing when a power of the sheet feeding device is turned on, a timing after processing misfeeding or double feeding, a timing after inputting kind and thickness of the sheet set on the sheet stacking table, and a timing when a user instructs air amount adjustment.

11. The sheet feeding apparatus of claim 2, wherein the predetermined timing is any one of a timing after operating the sheet feeding table to set the sheet, a timing when a power of the sheet feeding device is turned on, a timing after processing misfeeding or double feeding, a timing after inputting kind and thickness of the sheet set on the sheet stacking table, and a timing when a user instructs air amount adjustment.

12. The sheet feeding apparatus of claim 2, wherein the detection device is configured to detect the sheet at a standard height which is higher than a height of the sheets stacked by a predetermined amount, and the control section sets the optimum air amounts using an air amount when the sheet reaches the standard height by gradually increasing an air amount of the assist air blower device, the separation air blower device or the flotation air blower device, or an air amount at which the detection device detects that the sheet leaves from the standard height.

13. The sheet feeding apparatus of claim 2, wherein the detection device is configured to detect the sheet at a standard height which is higher than a height of the sheets stacked by a predetermined amount, and the control section sets the optimum air amounts based on a measured time at which the sheet reaches the standard height or at which the sheet leaves the standard height while keeping the air amount of the assist air blower device, the separation air blower device or the flotation air blower device constant.

14. The sheet feeding apparatus of claim 2 wherein the detection device is configured to detect a leaving of the sheet, floated to a height of the perforated belt via the flotation air device, from the perforated belt member and the control device sets the optimum air amount of the separation air using an air amount at which the sheet leaves from the perforated belt member by gradually increasing the air amount of the separation air blower device while keeping the air amount of the flotation air blower device constant.

15. An image forming system, comprising:

the sheet feeding apparatus of claim 2; and an image forming apparatus to form an image on the sheet fed from the sheet feeding device.

16. A sheet feeding apparatus, comprising:

a sheet stacking table to stack sheets;

an air suction sheet feeding device to feed the sheets one by one from an upper section of the sheets stacked on the sheet stacking table, the air suction sheet feeding device comprising (i) an air suction member disposed to oppose an upper surface of the sheet stacked to suction the sheet, and (ii) a perforated belt member disposed in a rotational manner so as to turn about an outer circumference of the air suction member;

a flotation air blower device to blow a flotation air at a lateral side, a front side or a rear side of the sheet fed from the sheet stacking table so as to float the sheet;

a separation air blower device to blow a separation air at a lateral side, a front side or a rear side of the sheet fed from the sheet stacking table so as to separate the sheet suctioned by air;

a detecting device to detect a behavior of the sheet floated by the flotation air; and a control device to set an amount of the flotation air used in image forming to be an optimum air amount based on a detected result which is obtained via the detecting device by detecting a behavior of the sheet floated by operating the flotation air blower device and the air suction sheet feeding device at a predetermined timing without the separation air blower device being operated while image forming is not carried out.

17. The sheet feeding apparatus of claim 16, wherein the predetermined timing is any one of a timing after operating the sheet feeding table to set the sheet, a timing when a power of the sheet feeding device is turned on, a timing after processing misfeeding or double feeding, a timing after inputting kind and thickness of the sheet set on the sheet stacking table, and a timing when a user instructs air amount adjustment.

18. The sheet feeding apparatus of claim 16, wherein the detection device is configured to detect the sheet at a standard height which is higher than a height of the sheets stacked by a predetermined amount, and the control section sets the optimum air amounts using an air amount when the sheet reaches the standard height by gradually increasing an air amount of the assist air blower device, the separation air blower device or the flotation air blower device, or an air amount at which the detection device detects that the sheet leaves from the standard height.

19. The sheet feeding apparatus of claim 16, wherein the detection device is configured to detect the sheet at a standard height which is higher than a height of the sheets stacked by a predetermined amount, and the control section sets the optimum air amounts based on a measured time at which the sheet reaches the standard height or at which the sheet leaves the standard height while keeping the air amount of the assist air blower device, the separation air blower device or the flotation air blower device constant.

20. The sheet feeding apparatus of claim 16, wherein the detection device is configured to detect a height at which the sheet floats, and the control device is configured to set the optimum air amount based on a measured height to which the sheet reaches within a predetermined time while keeping the air amount of the flotation air blower device constant.

21. An image forming system, comprising:

the sheet feeding apparatus of claim 16; and an image forming apparatus to form an image on the sheet fed from the sheet feeding device.

22. The sheet feeding apparatus of claim 16, wherein the control device calculates the optimum air amount by adding a predetermined margin to an air amount based on detected information.

* * * * *